US005836034A

United States Patent [19]

Galvan Garza

[11] Patent Number: 5,836,034

[45] Date of Patent: Nov. 17, 1998

[54] COMBINED SOFT/ABRASIVE CLEANING SPONGE WIDTH PROJECTING PEAKS WITH ROUNDED TIPS

[76] Inventor: Jesus Javier Galvan Garza, Platon #799 Col. Contry La Silla, Guadalupe N.L., Mexico, 67170

[21] Appl. No.: 828,288

[22] Filed: Mar. 21, 1997

[51] Int. Cl.[6] ..... A47L 13/10; A47L 13/12

[52] U.S. Cl. ..... 15/118; 15/244.4

[58] Field of Search ..... 15/244.1, 244.3, 15/244.4, 118

[56] References Cited

U.S. PATENT DOCUMENTS

| | | | |
|---|---|---|---|
| 2,268,403 | 12/1941 | Kingman | 15/244.3 |
| 3,005,219 | 10/1961 | Miller | 15/244.3 |
| 4,111,666 | 9/1978 | Kalbow | 15/244.4 |
| 4,510,641 | 4/1985 | Morris | 15/244.3 |
| 4,866,806 | 9/1989 | Bedford | 15/244.4 |
| 5,214,820 | 6/1993 | Shumway et al. | 15/244.1 |

*Primary Examiner*—Terrence Till
*Attorney, Agent, or Firm*—Laurence R. Brown

[57] ABSTRACT

This invention relates to a soft/abrasive sponge, and more specifically to a sponge of the type that is used for cleaning any class of articles such as dishes, bathrooms, tiles etc., which combines in one body of any geometric shape one section of a soft surface, on the opposite section an extremely abrasive surface and on its peripheral sides a plurality of projecting salients which make up the rounded tips which provide the possibility to scrub places which only are penetrated with great difficulty by any other type of sponge when cleaning those areas.

6 Claims, 4 Drawing Sheets

COMBINED SOFT/ABRASIVE CLEANING SPONGE WIDTH PROJECTING PEAKS WITH ROUNDED TIPS

BACKGROUND TO THE INVENTION

For years, in all types of places such as homes, factories, restaurants, bathrooms, hotels, etc., people have used sponges or scourers to facilitate the cleaning of all those encrusted bits of dirt or grime that require hard scrubbing.

These scrubbing pads are numerous and varied in design, however, as far as I know, a scrubbing pad does not exist with the simple and yet very important characteristics of the one I have invented.

As will be obvious from the description and enclosed drawings, this invention offers a transcendental advantage in that while being only one sponge it has two faces, one being soft and the other highly abrasive allowing the sponge to rub softly or abrasively to clean an object. In addition, the multiple edges located on the peripheral sides of the sponge give it the indisputable advantage of being able to penetrate areas where other sponges cannot because the edges operate (as proven in experiments) as repetitive tips that incredibly remove accumulated dirt or grime from the inner corners and hard to reach places of objects being cleaned.

DESCRIPTION OF THE INVENTION

The invention is ilustrated in the accompanying drawings showing a preferred embodiment including specific parts and arrangements of parts. It is intended that the drawings, included as part of this specification be illustrative of a preferred embodiment of the invention.

Figure 1:
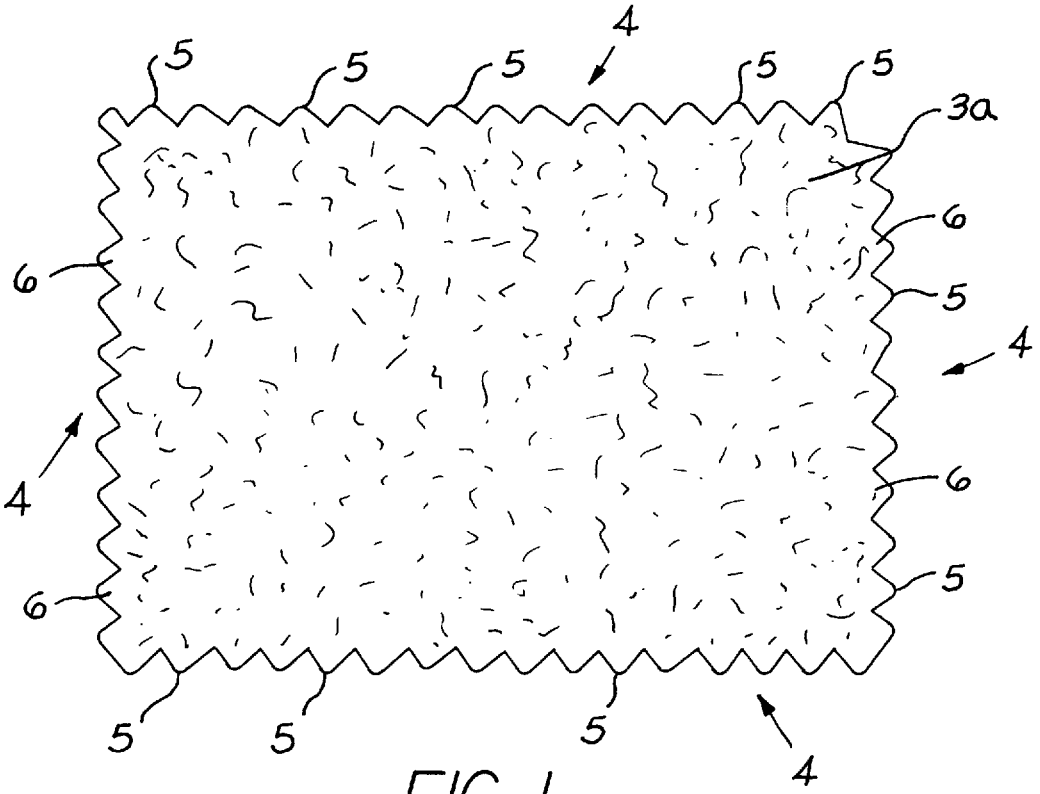
FIG. 1. Shows a plan view of the the abrasive section of the sponge.
Figure 2:
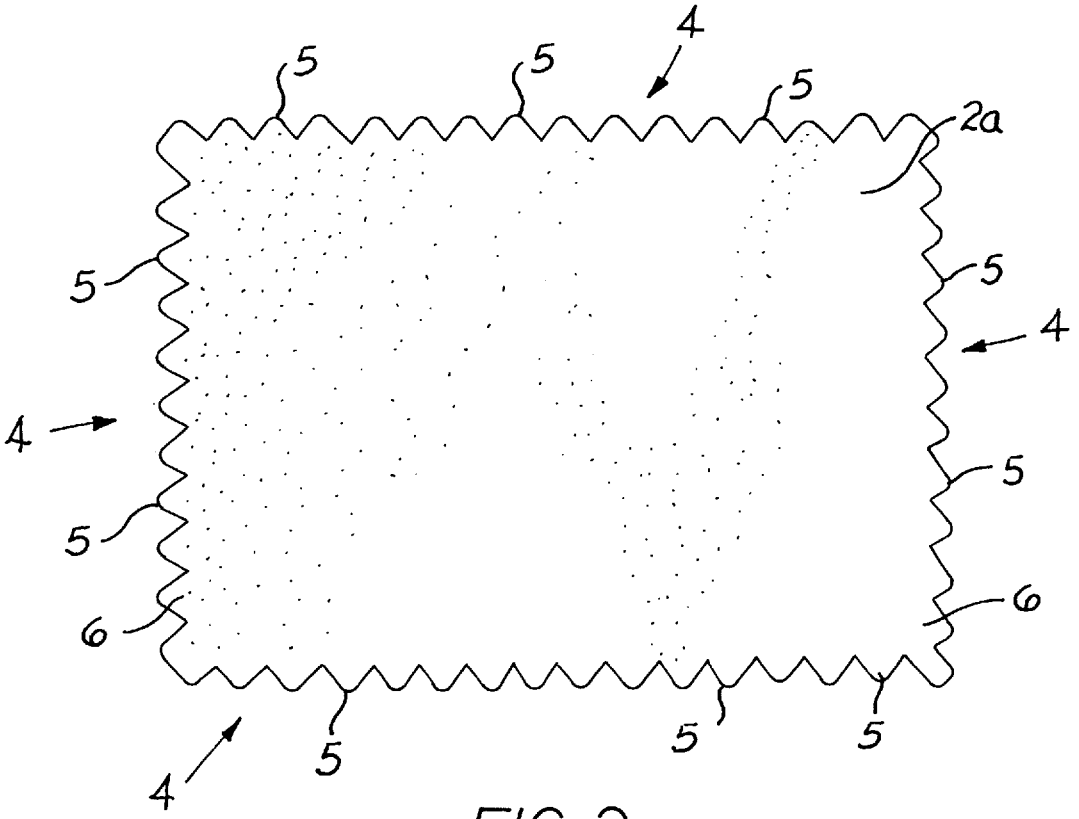
FIG. 2. Shows a plan view of the the soft section of the sponge.
Figure 3:
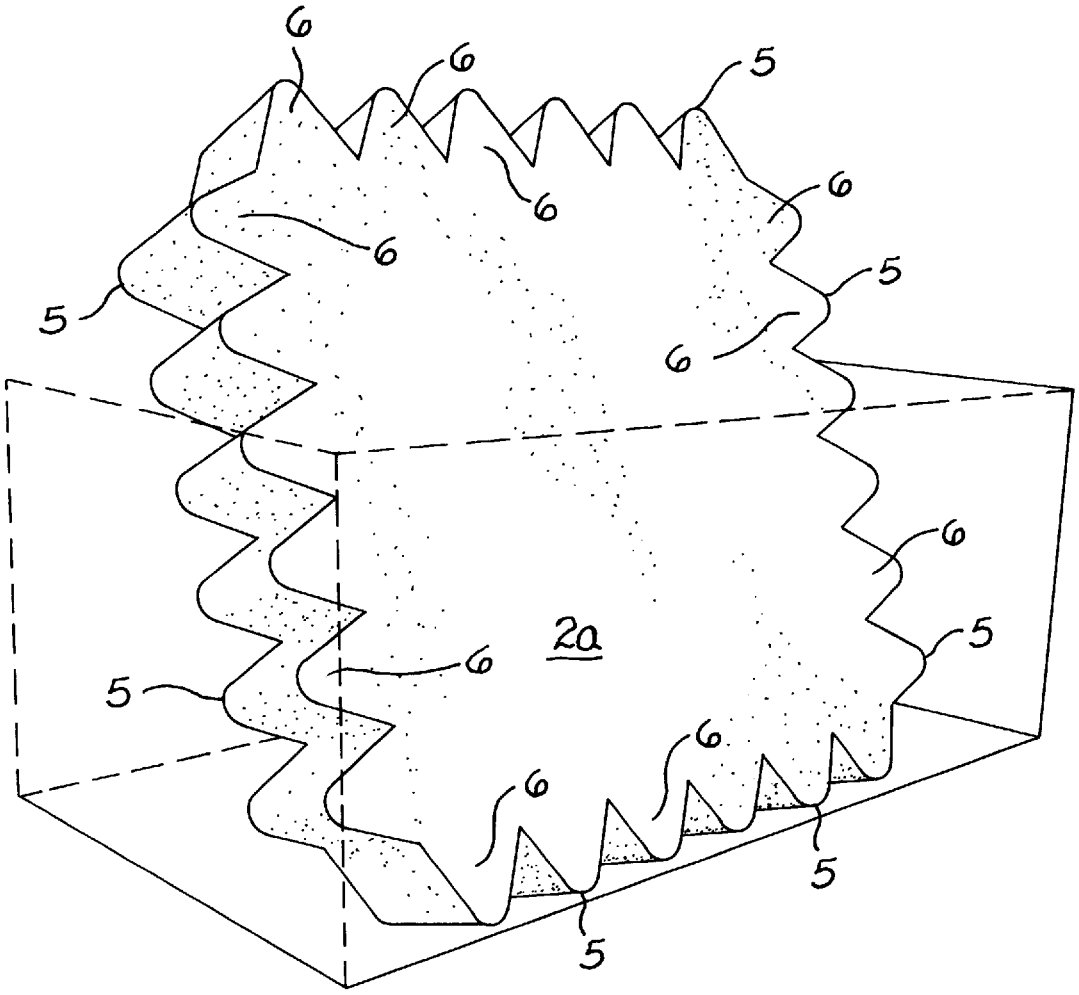
FIG. 3. Shows a sectional transverse view on which both soft and abrasive sections are shown.
Figure 4:
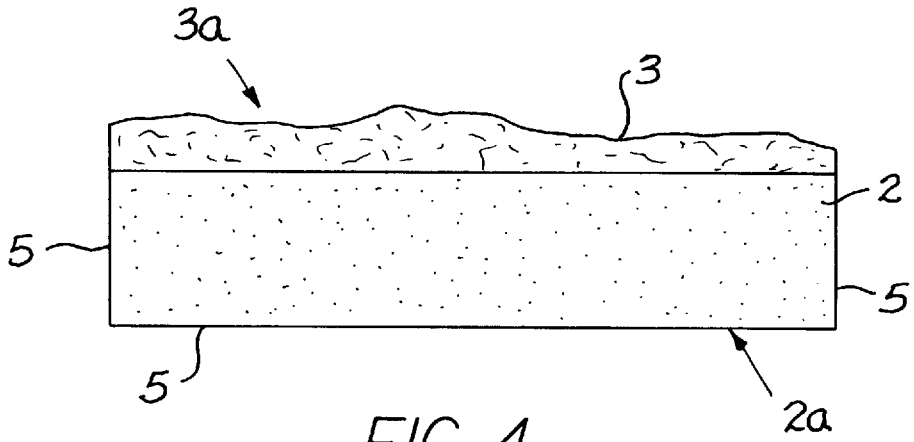
FIG. 4. Shows a cross section of the sponge.

Referring now to the drawings, the sponge comprises in combination a body, which is in turn formed by two sections (2 and 3). The soft section (2) which has as its principal characteristic its external face (2*a*) totally free of any elements than the natural softness of said face (2*a*). The abrasive section (3) which is manufactured to form an integral body with the soft section (2) provides on its external face (3*a*) an extremely abrasive surface, rough enough to remove all the dirt and grime encrusted in the area to be cleaned.

The surrounding area of the sides (4) of the sponge, which includes the soft section (2) and the abrasive section (3) is provided of a plurality of projecting salients (6), in a zig-zag pattern, with rounded tips (5) that at one end (5*a*) are highly abrasive and at the other end (5*b*) are soft.

As long as the surfaces to be cleaned do not have any awkward areas for wiping, the sponge can slide as easily along the surface as any other sponge on the market today. Alternatively, when the cleaning is carried out in areas with angles such as the inner converging walls of an object, the peripheral rounded tips (5) are effective for the required cleaning position, which means to say, by introducing the soft edge, the abrasive edge or if necessary both edges alternately.

Figure 5:
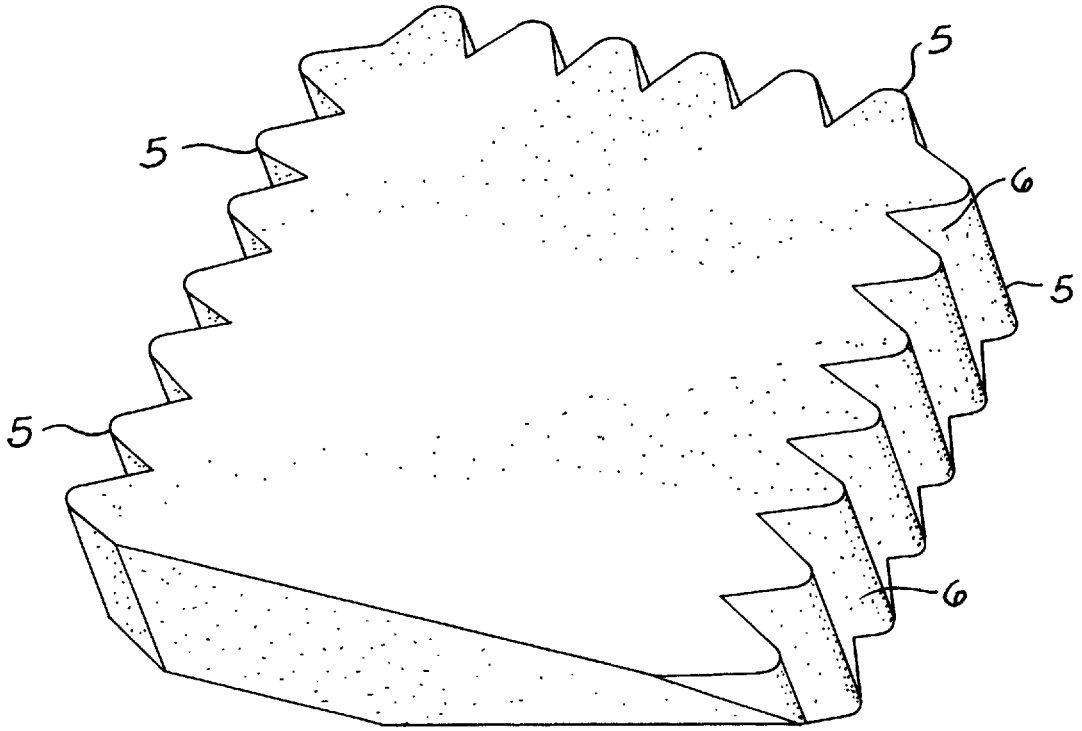
FIGS. 5,6,7,8 and 9. Show the different possible shapes the sponge can assume.
Figure 6:
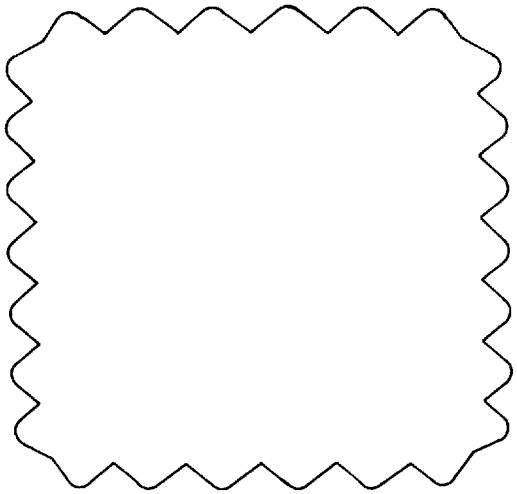
Figure 7:
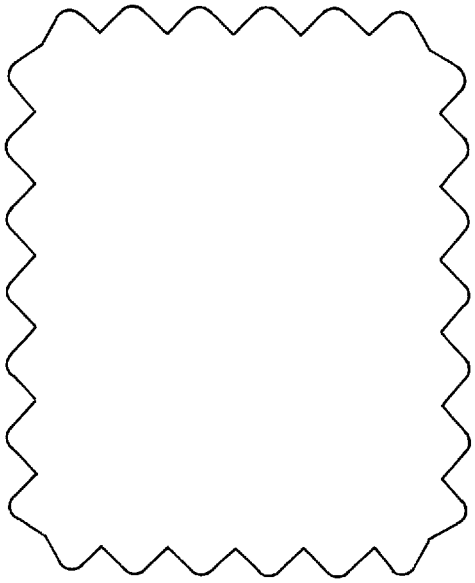
Figure 8:
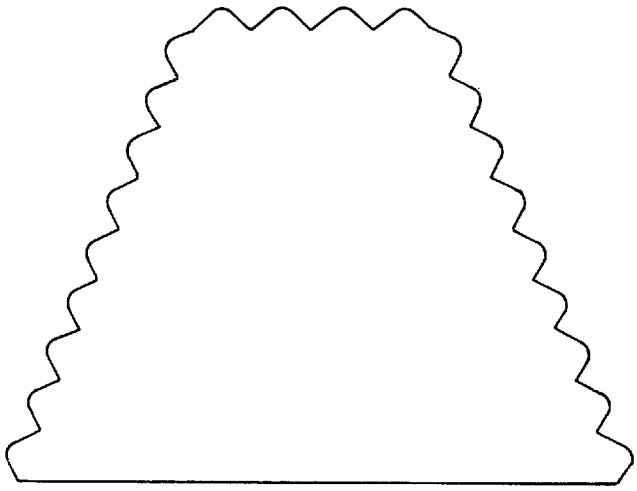
Figure 9:
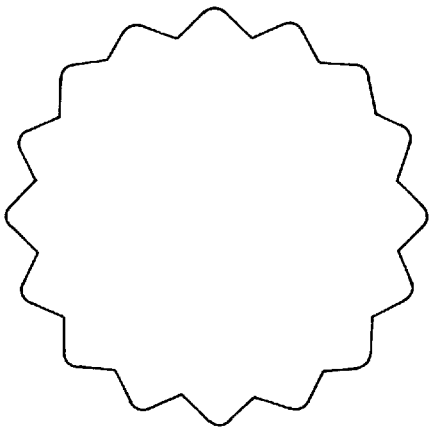

According to the task undertaken, the sponge can assume different shapes, for example for an easy approach to washing dishes the shape in FIG. 5 would be used, if the sponge was, to be used for cleaning bathroom areas, the shape in FIG. 6 would be used, if the sponge was to be used for cylindrical containers the shape in FIG. 7 would be used, if the sponge was to be used for square shaped containers the shape in FIG. 8 would be used and so on. For this reason as I have already pointed out I do not intend to limit the specified shape of the sponge but rather intend to patent the innovative combination of soft (2) and abrasive sections (3), projecting fibers and rounded tips which when acting together are the very essence of my invention.

Having thus fully described my invention what I claim is:

1. A cleaning sponge for cleaning the surfaces of dishes, bathrooms and tile, comprising in combination:

a single integral flexible and spongy body formed as a flexible planar sheet material of predetermined geometrical shape presenting opposed planar cleaning surfaces for wiping surfaces of the dishes, bathrooms and tile, said opposed cleaning surfaces having two diverse cleaning characteristics, namely: (a) an abrasive surface structure with sufficient roughness to dislodge dirt and grime encrusted upon said surfaces of the dishes, bathrooms and tile, and (b) a soft surface structure able to softly clean delicate surfaces, wherein said body further comprises a plurality of side-by-side salients extending about peripheral edges of said body bearing said opposed cleaning surfaces in a pattern retaining the opposed cleaning surfaces thereupon and exposing the salients to penetrate and scrub corners and irregularly shaped surfaces of said dishes, bathroom and tile with said abrasive surface structure to dislodge said dirt and grime therefrom.

2. The cleaning sponge of claim 1 wherein said salients further comprise a zig-zag pattern of regularly spaced salients extending about peripheral edges of said predetermined geometric shape.

3. The cleaning sponge of claim 2 wherein the salients extend about three lateral sides of the sponge.

4. The cleaning sponge of claim 2 wherein the predetermined shape is circular.

5. The cleaning sponge of claim 2 wherein said salients extend completely around peripheral edges of said predetermined geometric shape.

6. The cleaning sponge of claim 1 wherein said predetermined geometric shape is quadrilateral.

* * * * *